US005263288A

United States Patent [19]

Yang

[11] Patent Number: 5,263,288

[45] Date of Patent: Nov. 23, 1993

[54] SHED

[76] Inventor: Wen Tsai Yang, No. 31-6, Hou Chuang Rd., Taichung, Taiwan

[21] Appl. No.: 891,691

[22] Filed: Jun. 1, 1992

[51] Int. Cl.[5] ..... E04B 9/24

[52] U.S. Cl. ..... 52/79.6; 52/665; 52/714; 52/489; 403/407.1

[58] Field of Search ..... 52/665, 714, 236.9, 52/79.6, 489; 403/405.1, 406.1, 407.1, 381, 254

[56] References Cited

U.S. PATENT DOCUMENTS 4,494,346 1/1985 Gailey ..... 52/489
4,756,132 7/1888 Newman et al. ..... 52/235
4,878,323 11/1989 Nelson ..... 52/92

*Primary Examiner*—Carl D. Friedman
*Assistant Examiner*—Matthew E. Leno
*Attorney, Agent, or Firm*—Christensen, O'Connor, Johnson & Kindness

[57] ABSTRACT

A shed including a number of beams coupled between a pair of bars each having a pair of flanges formed in an upper portion, a number of supports each including a pair of ribs engaged with the flanges of the bars, and each having an extension formed on each of two walls, a slot formed in each side of the beam for engagement with the extensions of the walls, each of the supports including a resilient member extended upward for biasing the beam upwards, whereby, the beams are stably coupled between the bars.

5 Claims, 5 Drawing Sheets

SHED

BACKGROUND OF THE INVENTION

1. Field of the Invention

The present invention relates to a shed, and more particularly to the coupling portion of the bars for forming the shed.

2. Description of the Prior Art

Typically, sheds are built in front of a housing or beside a housing for shielding cars and the like, or the sheds are built above the top of the ceiling in order that the plants, particularly the vines, can be attached to the shed. Generally, the sheds includes a plurality of beams laterally disposed on a frame, the beams are fixed to the frame by bolts and the like. Therefore, a plurality of bolts should be screwed such that the beams can be fixed to the frame, this is inconvenient.

The present invention has arisen to mitigate and/or obviate the afore-described disadvantages of the conventional sheds.

SUMMARY OF THE INVENTION

The primary objective of the present invention is to provide a shed in which the beams can be easily fixed to the frame such that the shed can be easily assembled.

In accordance with one aspect of the invention, there is provided a shed comprising a frame including at least one pair of bars disposed on an upper portion thereof, and a plurality of beams coupled between the bars, each of the bars including a first engaging means formed in an upper portion thereof, a plurality of supports each including a second engaging means formed on a bottom portion thereof for engagement with the first engaging means, each of the support including a U-shaped cross section having two wall members extended upward therefrom, a third engaging means formed on each of the wall members, each of the beams including two side surfaces each having a fourth engaging means formed therein for engagement with the third engaging means of the wall members, whereby, the beams are stably coupled between the bars.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
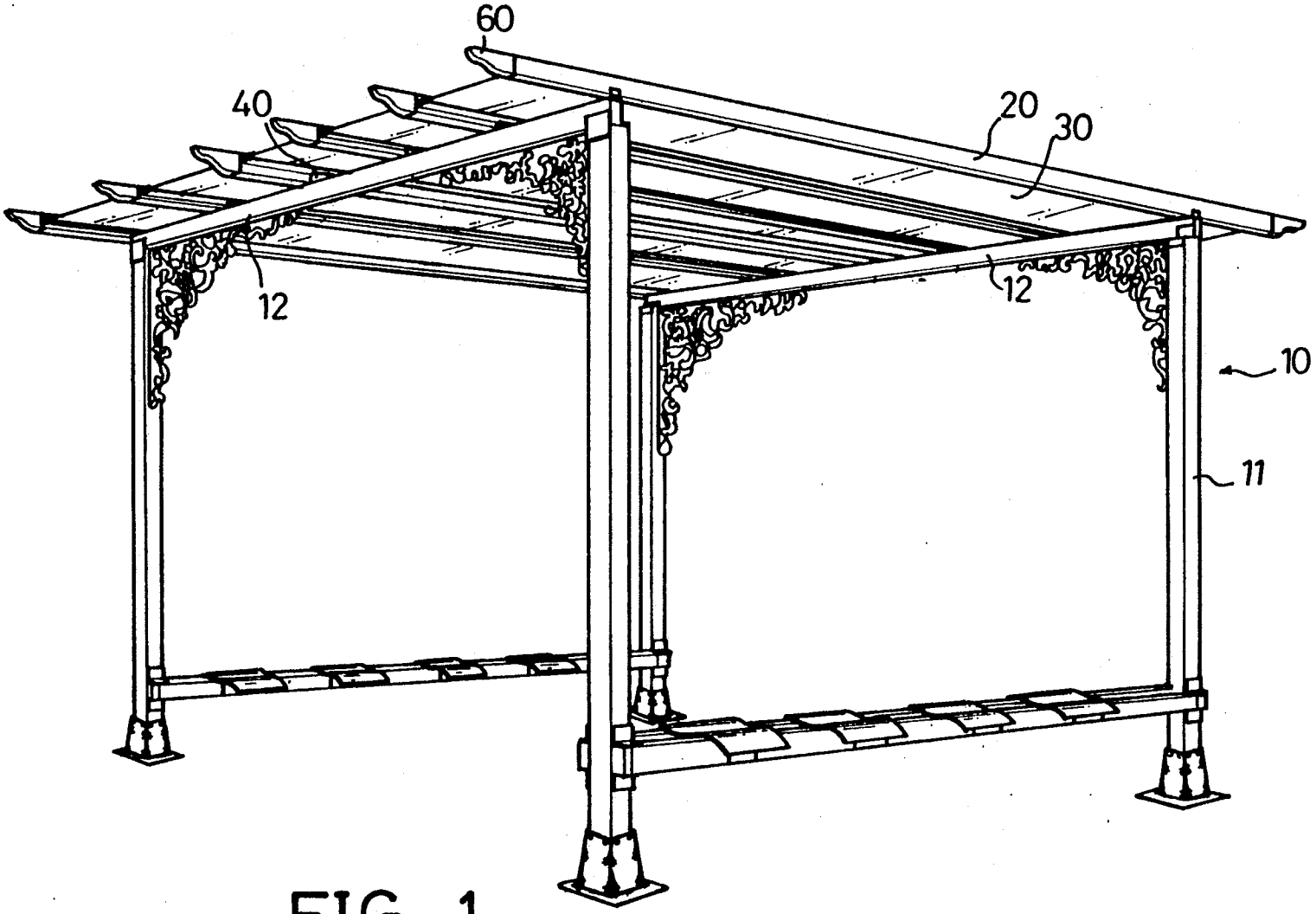
FIG. 1 is a perspective view of a shed in accordance with the present invention.

Referring to the drawings, and initially to FIG. 1, a shed in accordance with the present invention comprises generally a frame 10 including four posts 11 and two bars 12 supported in parallel upon the posts a plurality of beams 20 laterally supported in parallel upon the bars 12, and a transparent sheet member 30, such as a sheet of glass, engaged between every two adjacent beams 20. The present invention provides the coupling portions of the beams 20 to the bars 12 in order that the beams 20 can be easily coupled to the bars 12.

Referring next to FIGS. 2 to 5, each of the bars 12 includes a pair of flanges 14 longitudinally formed in an upper surface thereof and extended toward each other so as to form a channel, a plurality of supports 40 each includes a U-shaped cross section having a base 42 and two wall members 45 extended upward from the base 42, each of the supports 40 includes a pair of ribs 41 formed integral on the bottom of the base 42 thereof and extended away from each other for engagement in the channel of the bar 12 formed by the flanges 14, the supports 40 can further be fixed to the bars 12 by bolts 43. The base 42 of each of the supports 40 includes a resilient member 44 formed thereon and extended upward from the base 42. The upper end portions of the wall members 45 are slightly divergent, and an extension 46 is extended from each of the wall members 45 and extended inward and downward therefrom.

It is to be noted that, without the bolts 43, the supports 40 can also be stably engaged with the bars 12 by force-fitted engagements, such that the beams 20 can be easily coupled to the bars 12 without additional tools, such as screw driver for driving the bolts 43, which are required for assembling conventional sheds.

Each of the beams 20 includes two side portions 21 each having a holding means 22 formed integral thereon, each of the holding means 22 includes a pair of stripes 23, 24 for holding the sheet member 30 therebetween, it is preferable that a plurality of juts 25 extend downward from each of the upper stripes 23, and a projection 26 extends upward from the free end portion of each of the lower stripes 24 for facilitating the holding of the sheet member 30. A slot 28 is formed longitudinally along each of the side portions 21 of the beams 20 for engagement with the extensions 46 of the supports 40, and the bottom portion of the beam 20 is biased upward by the resilient member 44, best shown in FIGS. 4 and 5, such that the beams 20 can be stably held by the supports 40. An end element 60 is engaged in each end of each of the beams 20 (FIGS. 1 and 3).

Figure 2:
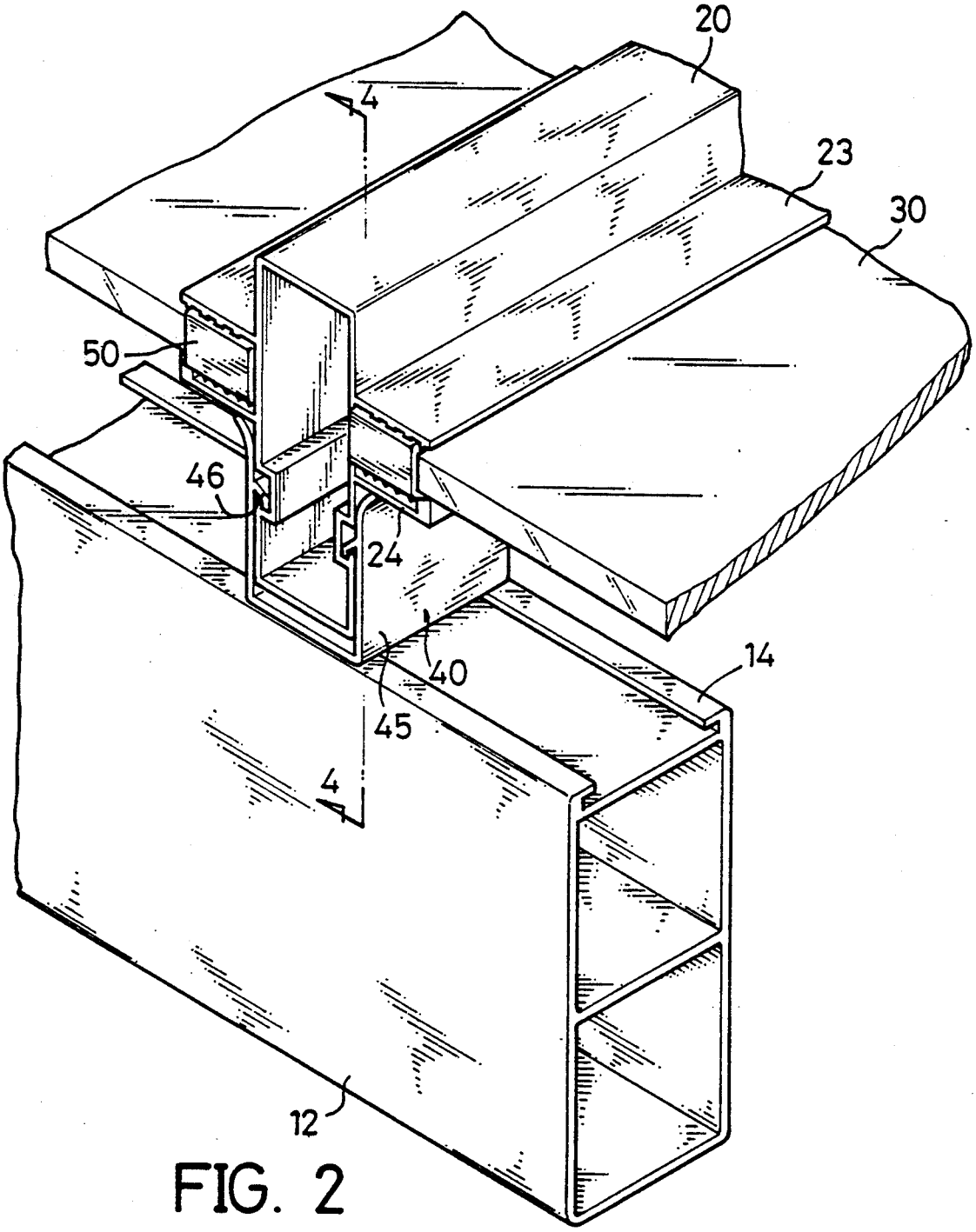
FIG. 2 is a partial perspective view of coupling portion of the beam to the frame of the shed.
Figure 3:
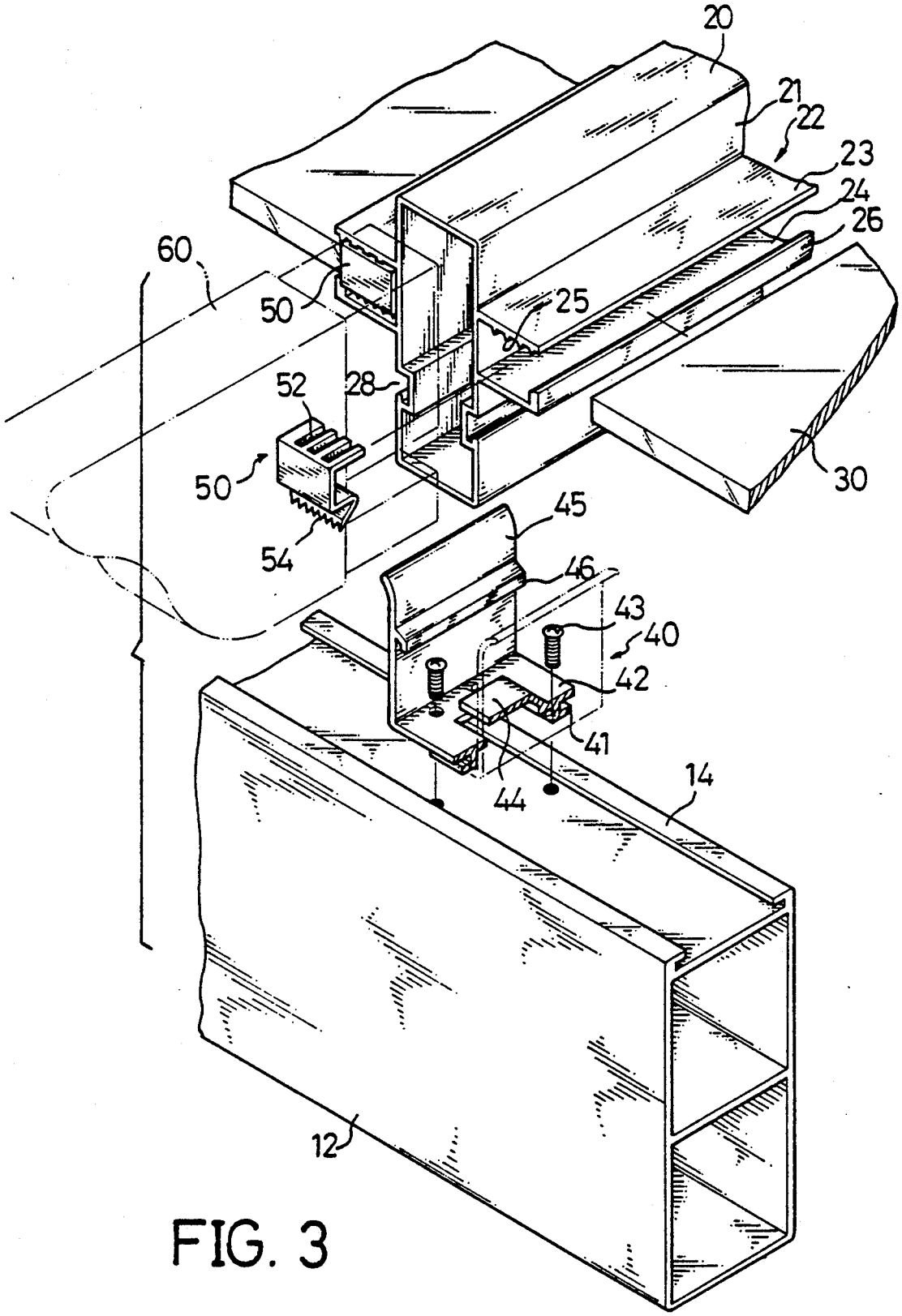
FIG. 3 is an exploded view of the coupling portion as show in FIG. 2
Figure 4:
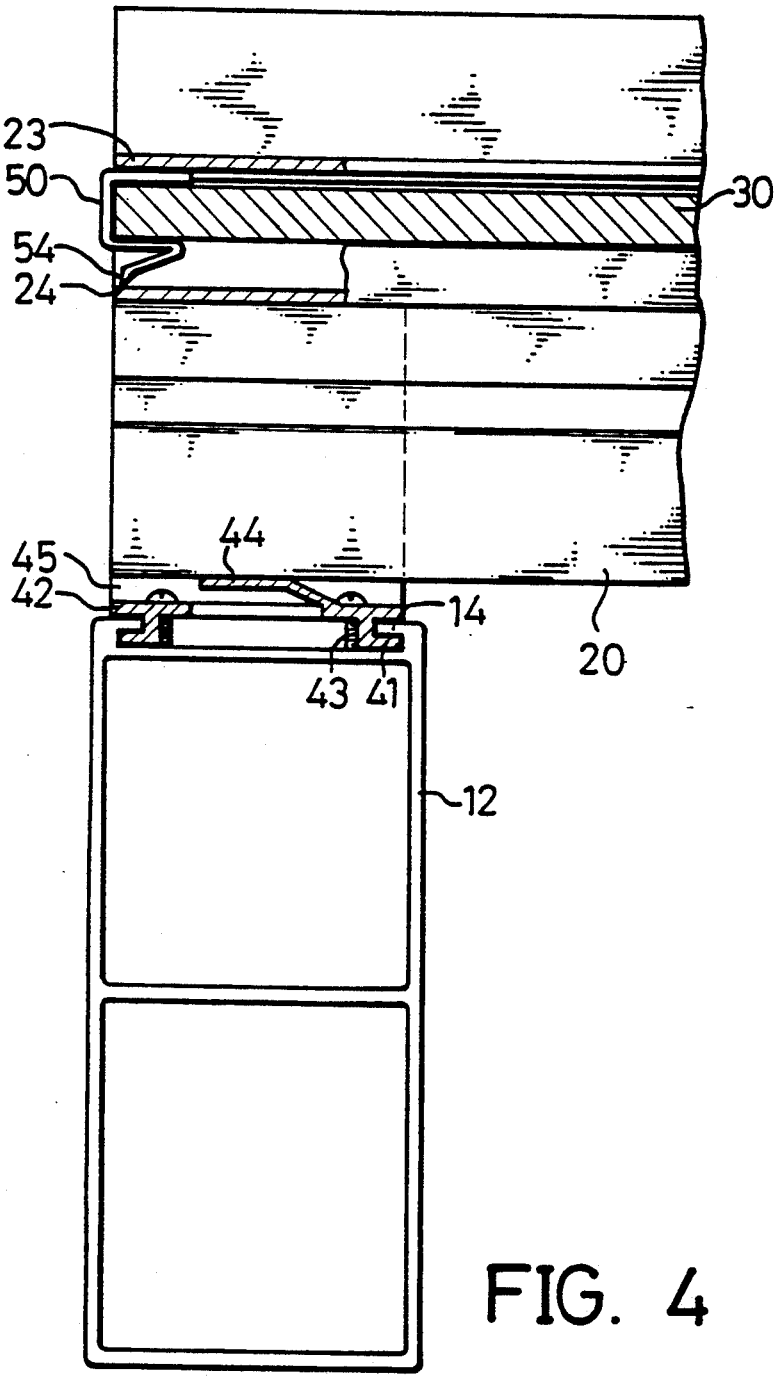
FIG. 4 is a partial cross sectional view taken along lines 4—4 of FIG. 2.
Figure 5:
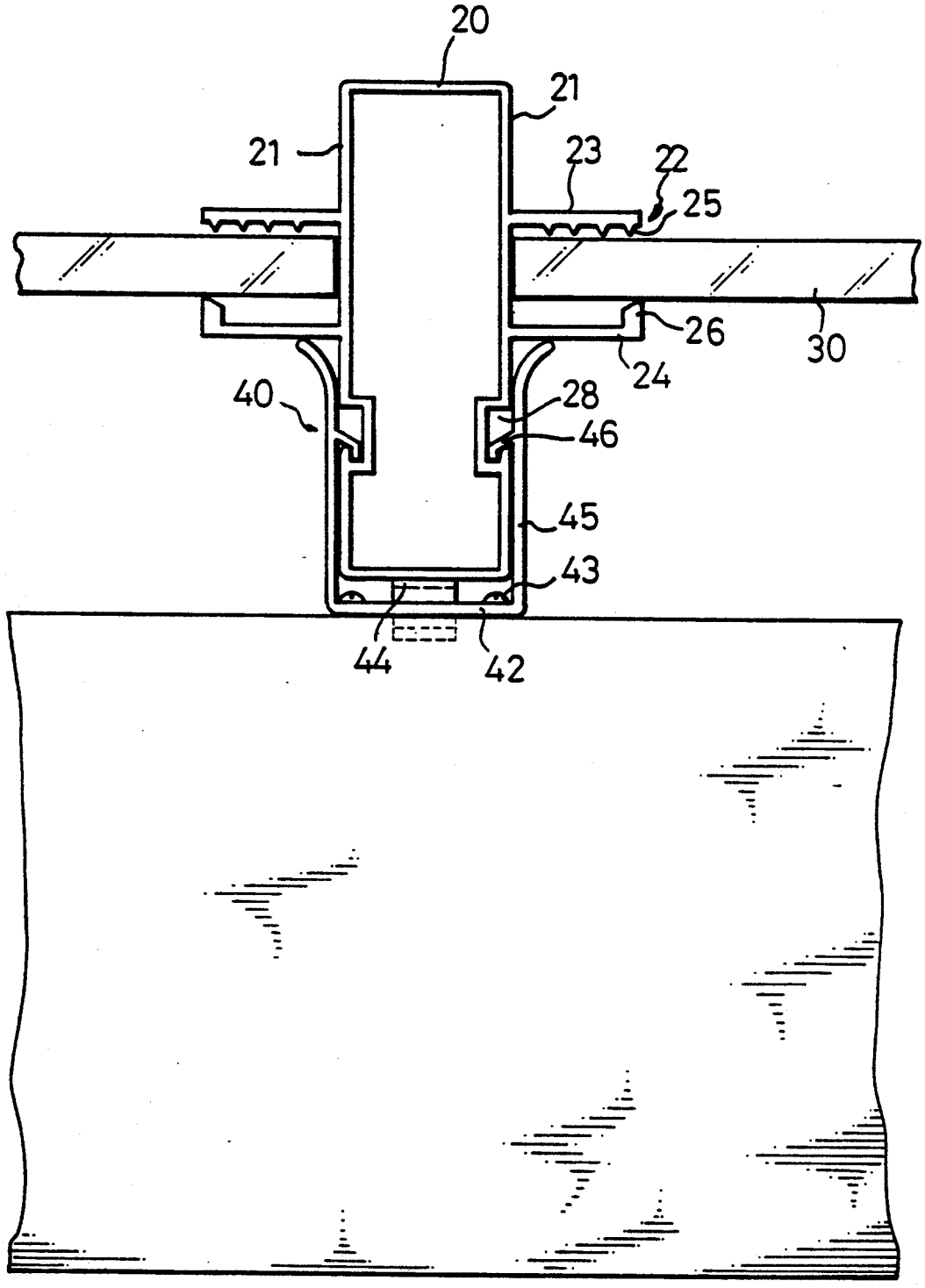
FIG. 5 is an end view of the coupling portion.

As best shown in FIGS. 2, 3 and 4, a coupler 50 has a substantially S-shaped cross section and includes a plurality of notches 52 formed in the upper portion thereof for engagement with the juts 25 of the holding means 22, and a plurality of teeth 54 formed in the bottom portion thereof for engagement with the upper surface of the respective stripe 24, such that the end portions of the sheet member 30 can further be stably held in place.

Accordingly, the shed in accordance with the present invention can be easily assembled.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A shed comprising a frame including at least one pair of bars disposed on an upper portion thereof, and a plurality of beams coupled between said bars, each of said bars including a first engaging means formed in an upper portion thereof, a plurality of supports each including a second engaging means formed on a bottom portion thereof for engagement with said first engaging means, each of said support including U-shaped cross section having two wall members extending upward therefrom, a third engaging means formed on each of said wall members, each of said beams including two side surfaces each having a fourth engaging means formed therein for engagement with said third engaging means of said wall members, a sheet material being coupled between every two adjacent said beams, each of said beams including side surfaces and a holding means formed integrally on each of said side surfaces for holding said sheet material in place, each of said holding means comprising an upper stripe which has a plurality of juts extending downward therefrom and a lower stripe which has a projection extending upward from a free end portion thereof for holding said sheet material in place, each of said holding means further comprising a plurality of couplers each of which have a plurality of notches formed in an upper portion for engagement with said juts of said upper stripe and a plurality of teeth formed in a bottom portion thereof for engagement with said lower stripe, each of said couplers being engaged in each end portion of each of said stripes for holding said sheet materials in place, whereby, said beams are stably coupled between said bars.

2. A shed according to claim 1, wherein said first engaging means comprises a pair of flanges formed on said upper portion of each of said bars and extended toward each other, said second engaging means of each of said supports comprises a pair of ribs formed on said bottom portion thereof and extended away from each other for engagement with said flanges of said bars, whereby, said beams are stably coupled to said bars.

3. A shed according to claim 1, wherein each of said supports includes a resilient member extended upward from said bottom portion thereof for biasing said beam upwards and holding said beams in place.

4. A shed according to claim 1, wherein said third engaging means comprises an extension formed integral on each of said wall members and extended inwards and downwards of said support, said fourth engaging means is a slot formed in each of said side surfaces of each of said beams for engagement with said extensions of said supports.

5. A shed comprising a frame including at least one pair of bars disposed on an upper portion thereof, and a plurality of beams coupled between said bars, each of said bars including a pair of flanges formed in an upper portion thereof and extending toward each other, a plurality of supports each including a pair of ribs formed on a bottom portion thereof and extending away from each other for engagement with said flanges of said bars, each of said support including a U-shaped cross section having two wall members extending upward therefrom, an extension formed integrally on each of said wall members and extending inwards and downwards of said support, each of said beams including two side surfaces each having a slot formed therein for engagement with said extensions of said wall members, each of said support including a resilient member extending upward from said bottom portion thereof for biasing said beam upwards, a sheet material coupled between every two adjacent said beams, each of said beams including side surfaces and a holding means formed integrally on each of said side surfaces for holding said sheet material in place, each of said holding means comprising an upper stripe which has a plurality of juts extending downward therefrom and a lower stripe which has a projection extending upward from a free end portion thereof for holding said sheet material in place, each of said holding means further comprising a plurality couplers each of which have a plurality of notches formed in an upper portion for engagement with said juts of said upper stripe and a plurality of teeth formed in a bottom portion thereof for engagement with said lower stripe, each of said couplers being engaged in each end portion of each of said stripes for holding said sheet materials in place, whereby, said beams are stably coupled between said bars.

* * * * *